US005398361A

United States Patent [19]

Cason

[11] Patent Number: 5,398,361

[45] Date of Patent: Mar. 21, 1995

[54] VACUUM CLEANER FOR SUBMERGED NON-PARALLEL SURFACES

[76] Inventor: Kurt N. Cason, 2008 Mountain Oak Rd., Bakersfield, Calif. 93311

[21] Appl. No.: 210,992

[22] Filed: Mar. 21, 1994

[51] Int. Cl.[6] ..... E04H 3/20

[52] U.S. Cl. ..... 15/1.7; 15/415.1

[58] Field of Search ..... 15/1.7, 414, 415.1, 15/418

[56] References Cited

U.S. PATENT DOCUMENTS

| | | | |
|---|---|---|---|
| 3,085,267 | 4/1963 | Jacuzzi | 15/1.7 |
| 3,360,816 | 1/1968 | Fontecchio | 15/1.7 |
| 3,626,535 | 12/1971 | Bond | 15/1.7 |
| 4,240,174 | 12/1980 | Thiem | 15/1.7 |
| 4,376,320 | 3/1983 | Linda | 15/1.7 |
| 4,402,101 | 9/1983 | van Zyl | 15/1.7 |
| 4,502,172 | 3/1985 | Chandler | 15/1.7 |
| 4,637,086 | 1/1987 | Goode | 15/1.7 |
| 4,776,053 | 10/1988 | Kiraly | 15/1.7 |
| 5,048,149 | 9/1991 | Heinen, Jr. | 15/328 |

*Primary Examiner*—Edward L. Roberts
*Attorney, Agent, or Firm*—Henry S. Miller

[57] ABSTRACT

A vacuum cleaner head for simultaneously use on submerged non-parallel surfaces, such as the bottom and side of a swimming pool. The cleaning head is divided into multiple parts, connected so that certain parts may rotate up to an angle of almost ninety degrees from the bottom.

1 Claim, 3 Drawing Sheets

VACUUM CLEANER FOR SUBMERGED NON-PARALLEL SURFACES

FIELD OF THE INVENTION

This invention relates to a vacuum cleaner and more particularly a vacuum cleaner cleaning head for simultaneously cleaning submerged non-parallel surfaces such as of the bottom and sides of a swimming pool.

BACKGROUND OF THE INVENTION

A typical swimming pool vacuum cleaner head cleans debris from the bottom and/or sides of a pool but not both, simultaneously.

Other vacuum cleaner heads have been described in, for example, U.S. Pat. Nos. 4,376,320; 4,402,101; 4,502,172; 4,776,058; and 5,048,149. All these devices suffer from the same defect in that they are unable to dean debris simultaneously from the bottom and sides of a pool.

SUMMARY OF THE INVENTION

Generally the invention relates to a vacuum cleaner of the type having a cleaning head used on submerged surfaces and means for connecting the cleaning head to a source of vacuum. The improvement comprises providing the cleaning head with at least first and second parts that are connected to each other for relative movement to enable the cleaning head to simultaneously engage the submerged surfaces lying in non-parallel planes.

Further features of the invention provide for a hinge connecting first and second parts. A conduit of flexible material connects chambers within the first and second parts. There also may be a third part connected to one of the sides of the first part, which is opposite to the side that the second part is connected. The first and third parts are also connected by a hinge and a conduit of flexible material.

Further features of the invention provide for caster type wheels arranged to support the cleaning head above a submerged surface.

DETAILED DESCRIPTION OF THE INVENTION

To more fully understand the invention, one presently preferred embodiment will now be described, by way of example, with reference to the accompanying drawings.

Figure 1:
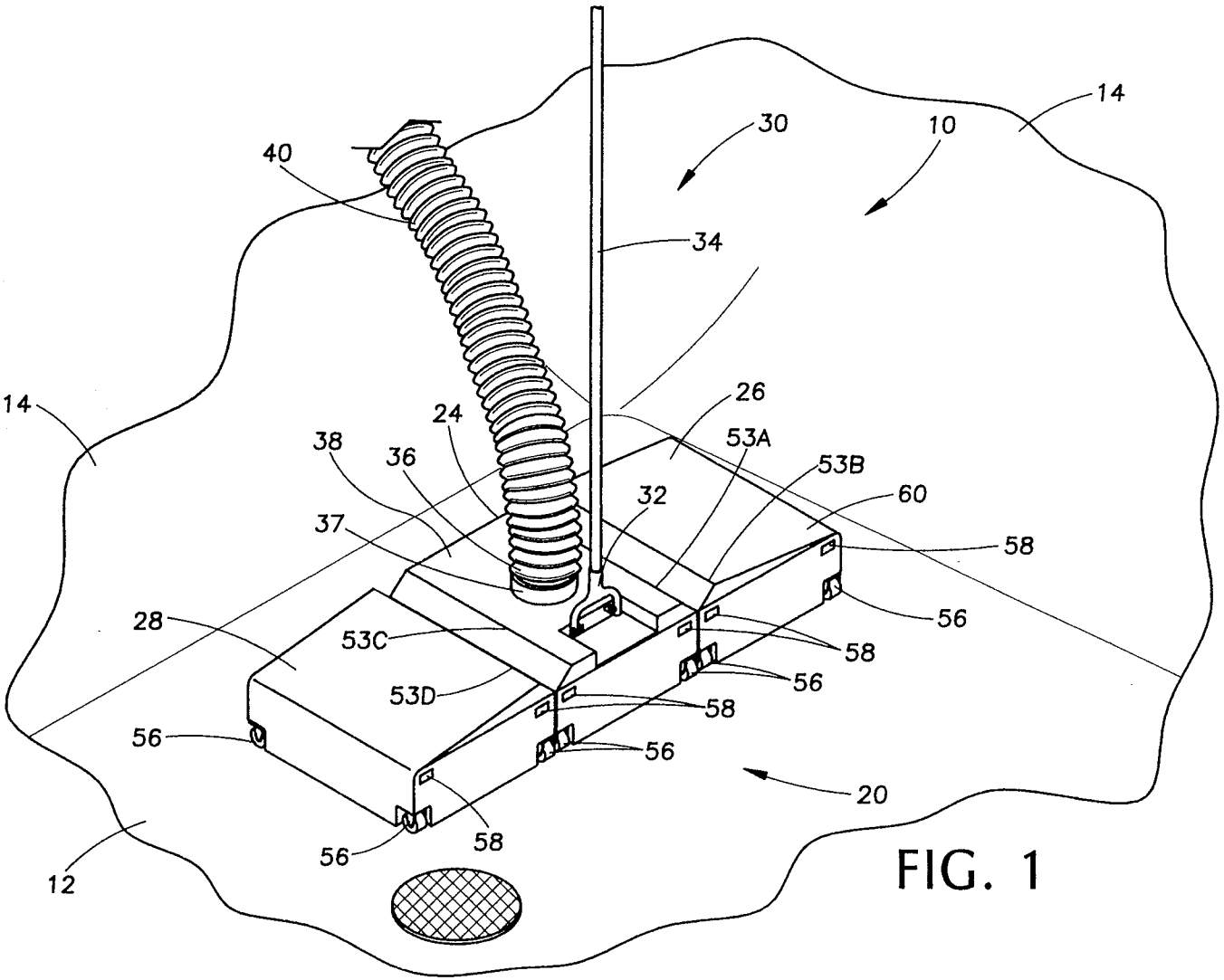
FIG. 1 is a pictorial view of a vacuum cleaner constructed in accordance with a presently preferred form of the invention.

FIG. 1 shows a vacuum cleaner 10 of the type which may be used to simultaneously clean the bottom 12 and sides 14 of a swimming pool. The vacuum cleaner 10 has a cleaning head 20 which includes a first part 24, a second part 26 and a third part 28.

A suitable manipulating member 30 is provided. It includes a connector member 32 that is hingedly attached to the first part 24 and a pole 34. The connector member 32 is threadingly connected to one end of the pole 34. The distal end of pole 34 can be operated to manipulate the cleaning head 20 on the bottom 12 and sides 14 of the pool.

A centrally located opening 36 that includes an upwardly directed collar 37 is provided in the top wall 38 of first part 24. One end of a suitable hose 40 may be connected by collar 37 to the first part 24 so that it is in fluid communication with said opening 36. The other end of the hose 40 may be connected to a suitable source of vacuum (not shown) as is well known in the art.

Figure 4:
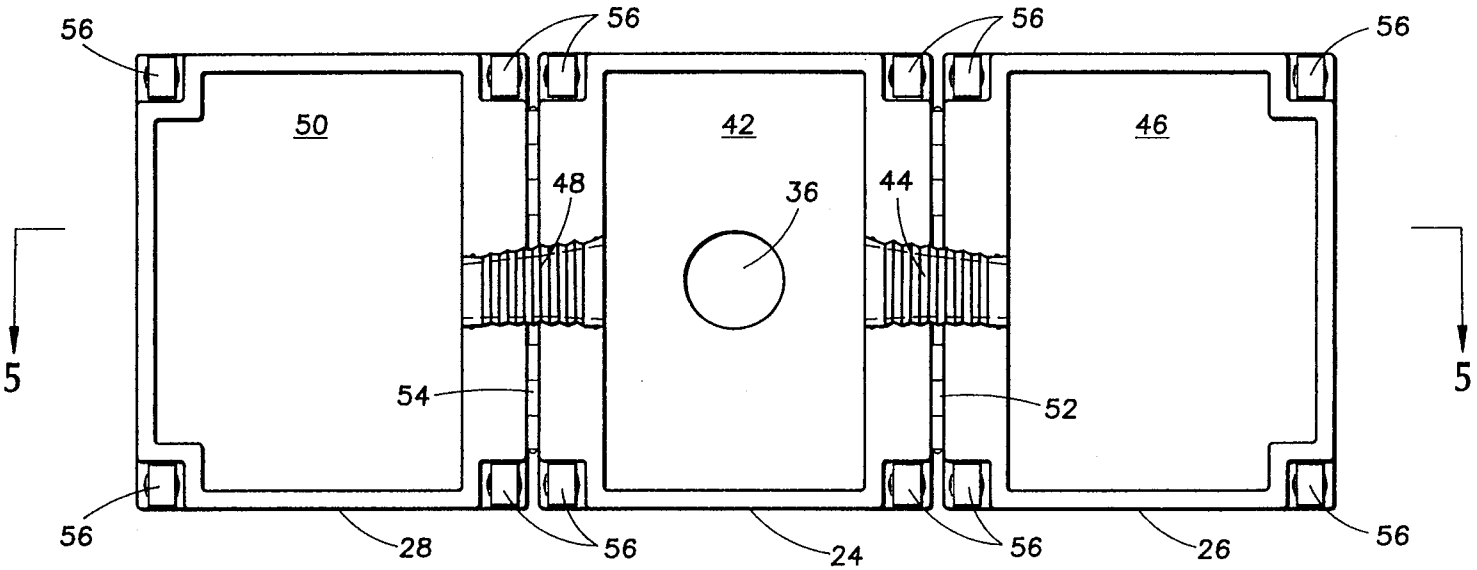
FIG. 4 is a bottom plan view of the device shown in FIG. 1.
Figure 5:
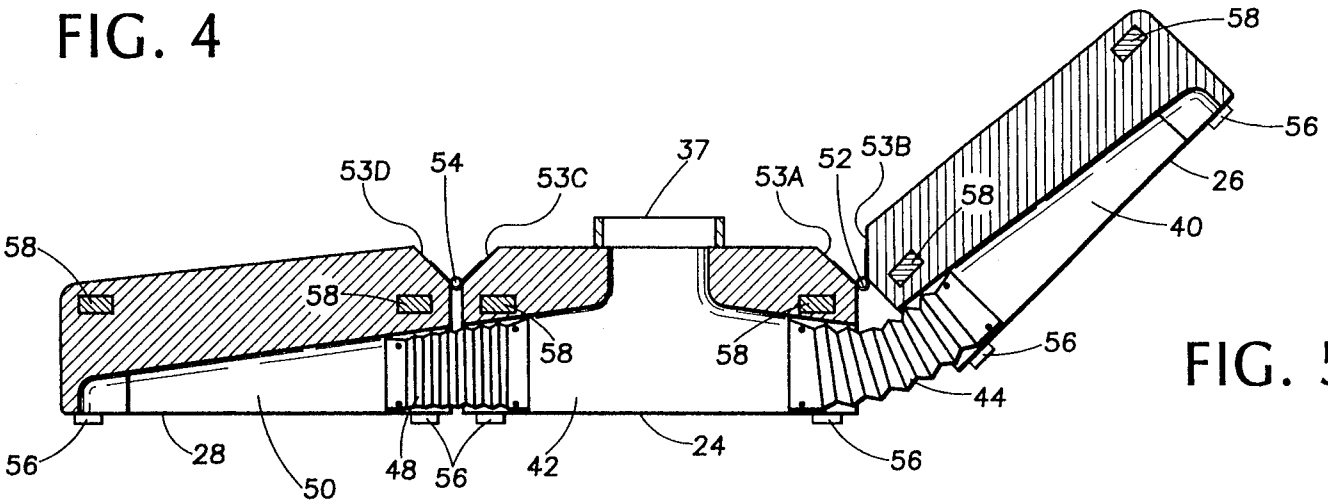
FIG. 5 is a partial sectional view taken along line 5—5 of the device shown in FIG. 4.

As best seen in FIGS. 4 and 5, the first part 24 includes a housing having a plurality of downwardly facing side walls that define a downwardly facing chamber 42. Chamber 42 provides a suitable space in which to collect debris to be withdrawn by the source of vacuum from the bottom and sides of the pool.

Chamber 42 is connected by conduit 44 to the second part 46 which includes a housing having a plurality of downwardly facing side walls that define a downwardly facing chamber 46. Chamber 46 also provides suitable space to collect debris.

Chamber 42 is also connected by conduit 48 to the third part 28 which includes a housing having a plurality of downwardly facing side walls that define a downwardly facing chamber 50. Chamber 50 also provides suitable space to collect debris.

Conduits 44 and 48 are made of a suitable flexible resilient material such as rubber, neoprene or the like and in the presently preferred form have an accordion shape.

Conduit 44 conveniently maintains a vacuum between chamber 42 and chamber 46. Conduit 48 conveniently maintains a vacuum between chamber 42 and chamber 50. Therefore conduits 44 and 48 provide for suitable fluid communication between chambers 42, 46, and 50 enabling the source of vacuum to withdraw debris from a substantial surface area.

The adjacent side walls of parts 24 and 26, and 24 and 28 include bevels 53A, 53B, 53C, and 53D, in that they define generally "V" groves whose included angle is about ninety degrees.

Figure 2:
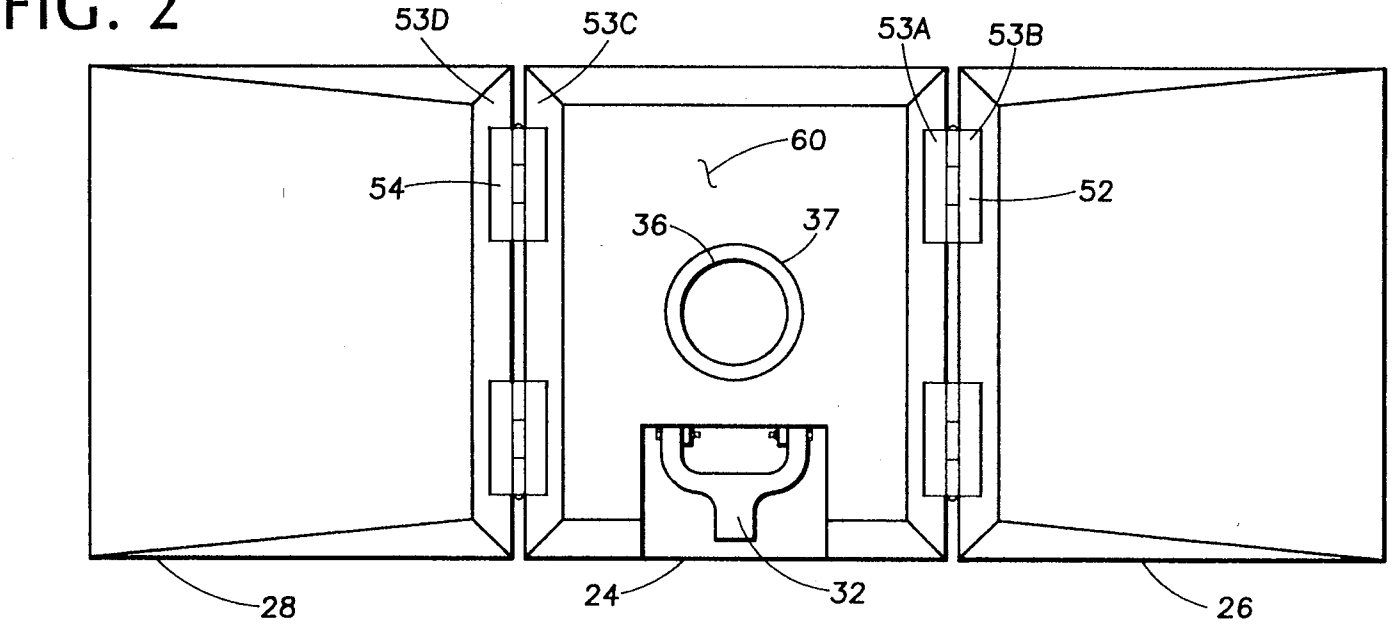
FIG. 2 is a top plan view of the device shown in FIG. 1.

As best seen in FIG. 2, a suitable hinge 52 is provided for connecting one of the side walls of the first part 24 to one of the side walls of the second part 26 along bevels 53A and 53B. A suitable hinge 54 is provided for connecting the other side wall of the first part 24 to one of the side walls of the third part 28 along bevel 53C and 53D. The hinge 52 connecting beveled surfaces 53A and 53B, the hinge 54 connecting beveled surfaces 53C and 53D, in conjunction with conduits 44 and 48, as best seen in FIG. 5, enable the second part 26 and/or the third part 28, respectively, to pivot to a ninety degree angle from the first part 24 and engage and clean debris from any side of the pool while the first part 24 simultaneously cleans debris from the bottom of the pool.

Figure 3:
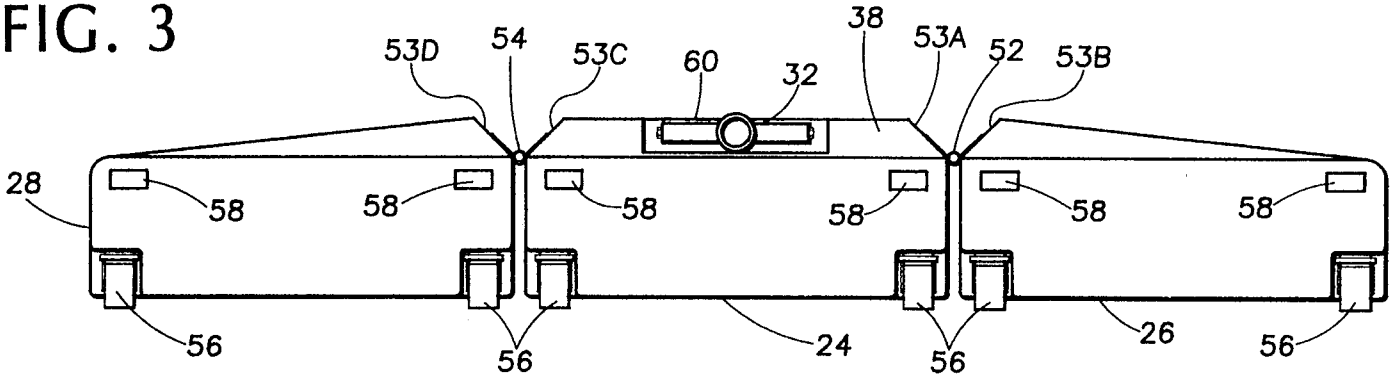
FIG. 3 is a elevation view of the device shown in FIG. 1.

As best seen in FIG. 3, suitable means such as wheels 56 may facilitate cleaning be provided to hold the cleaning head 20 away from the surfaces to be cleaned to facilitate cleaning. The wheels 56 are supported by shafts (not seen). The wheels 56 are rotatably mounted on the parts 24, 26 and 28 of the cleaning head 20. Preferably the wheels 56 may be caster type wheels that have the advantage of enabling multidirectional movement of the cleaning head 20. Each of the parts 24, 26 and 28 may have a caster at each of its corners.

Also best seen in FIG. 3 are weights 58 conveniently located near the top 60 of each of the parts 24, 26, and 28. The weight 58 prevent the cleaning head 20 from floating off the bottom 12 of the pool during cleaning. The cleaning head 20 may float off the surface because it is generally made from suitable plastic material having a density less than the fluid in which it is submerged.

In use, the vacuum source is energized to provide suction which assists in drawing the cleaning head 20 to the bottom of the pool. The operator may manually maneuver the long pole 34 to push the cleaning head 20 in any direction along the bottom of the pool. As the cleaning head is pushed along the bottom, the second part 26 or the third part 28 may engage the side of the pool. The operator may manually maneuver the pole 34 to raise and then lower the cleaning head 20 so that the second part 26 or the third part 28 will first engage the side wall along the bottom and then rotate up to an angle of ninety degrees from the first part as the cleaning head 20 is lowered to be against the side wall. This enables the second part 26 or third part 28 to clean debris from the side wall while the first part 24 simultaneously cleans debris from the bottom.

In particular, a cleaning head 20 including the first part 24 and the second part 26 and not the third part 28 with the related members would be example of an embodiment that does not depart from the scope of the invention. Installing half-moon shaped wedges on the perimeter of the parts 24, 26,and 28 for providing greater durability, or the cleaning head 20 being such colors such as lime green, hot pink and florescent orange, for providing greater visibility, would be examples of embodiments that do not depart from the scope of the invention.

While the invention has been described with respect to certain forms, it is apparent that other forms will be obvious to those skilled in the art in view of the foregoing description. Thus the scope of the invention should not be limited by the description but, rather, only by the scope of the claims appended hereto.

I claim:

1. In a vacuum cleaner of the type used on submerged surfaces and having a cleaning head and means for connecting said cleaning head to a source of vacuum so that fluid surrounding said cleaning head can be withdrawn through said cleaning head, the improvement comprising:

(a) said cleaning head comprising
- a first part;
- a first chamber in the first part;
- a second part hingedly connected to the first part;
- a second chamber in the second part;
- a third part hingedly connected to the first part;
- a third chamber in the third part; and
- a first flexible conduit connected, at one end, to the first part and connected, at another end, to the second part;
- the first chamber communicating with the second chamber through the first flexible conduit;
- a second flexible conduit connected, at one end, to the first part and connected, at another end, to the third part;
- the first chamber communicating with the third chamber through the second flexible conduit;
- a third flexible conduit connected, at one end, to the first part and connected, at another end, to a vacuum source;
- the vacuum source communicating with the first chamber through the third flexible conduit;
- the second chamber tapering upward from a shorter distal end to a higher proximate end near the first flexible conduit; and
- the third chamber tapering upward from a shorter distal end to a higher proximate end near the second flexible conduit;

(b) a plurality of multi-directional rotational castor-type wheels on the cleaning head;

(c) a manipulating member releasably attached to the cleaning head; and (d) a plurality of non-flotation weights on the cleaning head.

* * * * *